US006478488B1

(12) United States Patent
Engel et al.

(10) Patent No.: US 6,478,488 B1
(45) Date of Patent: Nov. 12, 2002

(54) STEP-STRIPPER ROLLER SHAFT IN AN IMAGE FORMING DEVICE

(75) Inventors: James William Engel, Simi Valley, CA (US); John Tomasik, Littleton, CO (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/345,274

(22) Filed: Jun. 30, 1999

(51) Int. Cl.[7] ..... B41J 15/16
(52) U.S. Cl. ..... 400/618; 400/641; 400/611
(58) Field of Search ..... 400/648, 659, 400/641, 618, 611; 101/288

(56) References Cited

U.S. PATENT DOCUMENTS

| | | | | |
|---|---|---|---|---|
| 3,425,345 A | | 2/1969 | Voigt et al. | 101/292 |
| 4,737,223 A | | 4/1988 | Koch | 156/475 |
| 5,172,989 A | * | 12/1992 | Imaseki et al. | 400/641 |
| 5,174,669 A | * | 12/1992 | Fushimi et al. | 400/617 |
| 5,401,352 A | | 3/1995 | Matsushita et al. | 156/384 |
| 5,427,460 A | | 6/1995 | Kijiya | 400/118.1 |
| 5,625,400 A | * | 4/1997 | Kubo | 347/197 |
| 5,800,669 A | * | 9/1998 | Goodwin et al. | 101/288 |
| 5,820,279 A | * | 10/1998 | Lodwig et al. | 400/234 |

FOREIGN PATENT DOCUMENTS

| | | |
|---|---|---|
| EP | 0 416 802 A1 | 3/1991 |
| EP | 0 764 585 A1 | 3/1997 |

* cited by examiner

*Primary Examiner*—Daniel J. Colilla
(74) *Attorney, Agent, or Firm*—Fulbright & Jaworski LLP

(57) ABSTRACT

An image forming device for separating a printable medium from a continuous protective backing strip attached thereto includes a stepped stripper roller shaft encircled by a roller sleeve adapted to press a platen of the device wherein the image forming device causes the continuous strip to pass over a stripper bar and directs the protective backing strip to move under the stripper bar and between the platen and the roller sleeve while the printable medium continuously moves out of the device from over the stripper bar.

29 Claims, 3 Drawing Sheets

STEP-STRIPPER ROLLER SHAFT IN AN IMAGE FORMING DEVICE

FIELD OF THE INVENTION

The present invention relates generally to image forming devices, and more particularly to a printer that automatically separates self-adhesive portions of print media from a continuous strip of protective backing without causing excessive looping or jamming of the printer.

BACKGROUND OF THE INVENTION

Self-adhesive labels have been in use for many years. Typically, self-adhesive labels come on a continuous strip, such as in a roll, and have a front side suitable for writing or printing information, an adhesive back side, and a protective backing forming the strip and adhering to the adhesive back side of the labels. Before using the printed labels, the labels must be peeled away from the protective backing and adhered to a medium, e.g., an envelope or a box, for labeling.

Conventional devices designed to print information on the self-adhesive labels and automatically peel off the printed (or imaged) labels from the protective backing include the Eltron LP-2042 printer. Typically, the continuous strip of the labels enters a conventional device, such as a printer from a first location of the device—normally the back side of the device. After entering, the strip passes through a contact area between a print head and a platen of the device, and then leaves the device from a second location-normally the front side of the device. Ideally, the printed (or imaged) labels should be peeled off from the protective backing strip as it leaves the device. Unfortunately, when certain printing processes (such as thermal transfer) and/or small media are used, conventional devices tend to fail when the protective backing forms a loop between the print head and an exit roller (which directs the protective backing out of the devices). Such failure may occur before and/or after the labels have been removed from the protection backing and may generally result in either the labels failing to detach and following the protective backing through the exit roller, or the labels only partially separating and adhering to the exit roller.

Other types of conventional devices do not automatically remove the protective backing from the labels and require the user to manually peel the protective backing off the printed labels. Such devices, however, are inconvenient for users and efficient in today's busy world. Even so, these devices are also not immune from the above-noted looping problems.

SUMMARY OF THE INVENTION

An object of the present invention is to provide an image forming device that will automatically separate detachable adhesive print media from a continuous protective backing strip without causing excessive looping or jamming to the image forming device.

One embodiment of the present invention provides an image forming device, e.g., a printer, comprising a print head; a platen for pressing a print medium, such as a sheet of paper or a series of self-adhesive labels attached to a continuous protective backing strip, against the print head and for moving the printing medium during operation; a stripper bar properly angled upward and adapted to separate the self-adhesive labels from the protective backing strip when it passes over the stripper bar; and a stripper roller positioned under the stripper bar. Initially the stripper roller causes the protective backing strip to pass under the stripper roller at a first speed sufficiently different from a second speed of the label strip passing between the print head and the platen to prevent looping or jamming of the protective backing and label strip.

In a preferred embodiment, the roller includes a stepped stripper roller shaft encircled by a sleeve and adapted to cause the protective backing strip to initially pass between the stripper roller and the platen at a first speed sufficiently different from a second speed of the strip passing between the print head and the platen until the tension on the protective backing strip reaches equilibrium which equalizes the first and second speeds of the protective backing strip respectively. The stepped roller shaft is also adapted to prevent looping of the protective backing strip when used in conjunction with narrow print media.

The foregoing and additional features and advantages of this present invention will become apparent by way of non-limitative examples shown in the accompanying drawings and detailed description that follow. In the figures and written description, numerals indicate the various features of the invention, like numerals referring to like features throughout both the drawing figures and the written description.

DETAILED DESCRIPTION OF THE INVENTION

Figure 1:
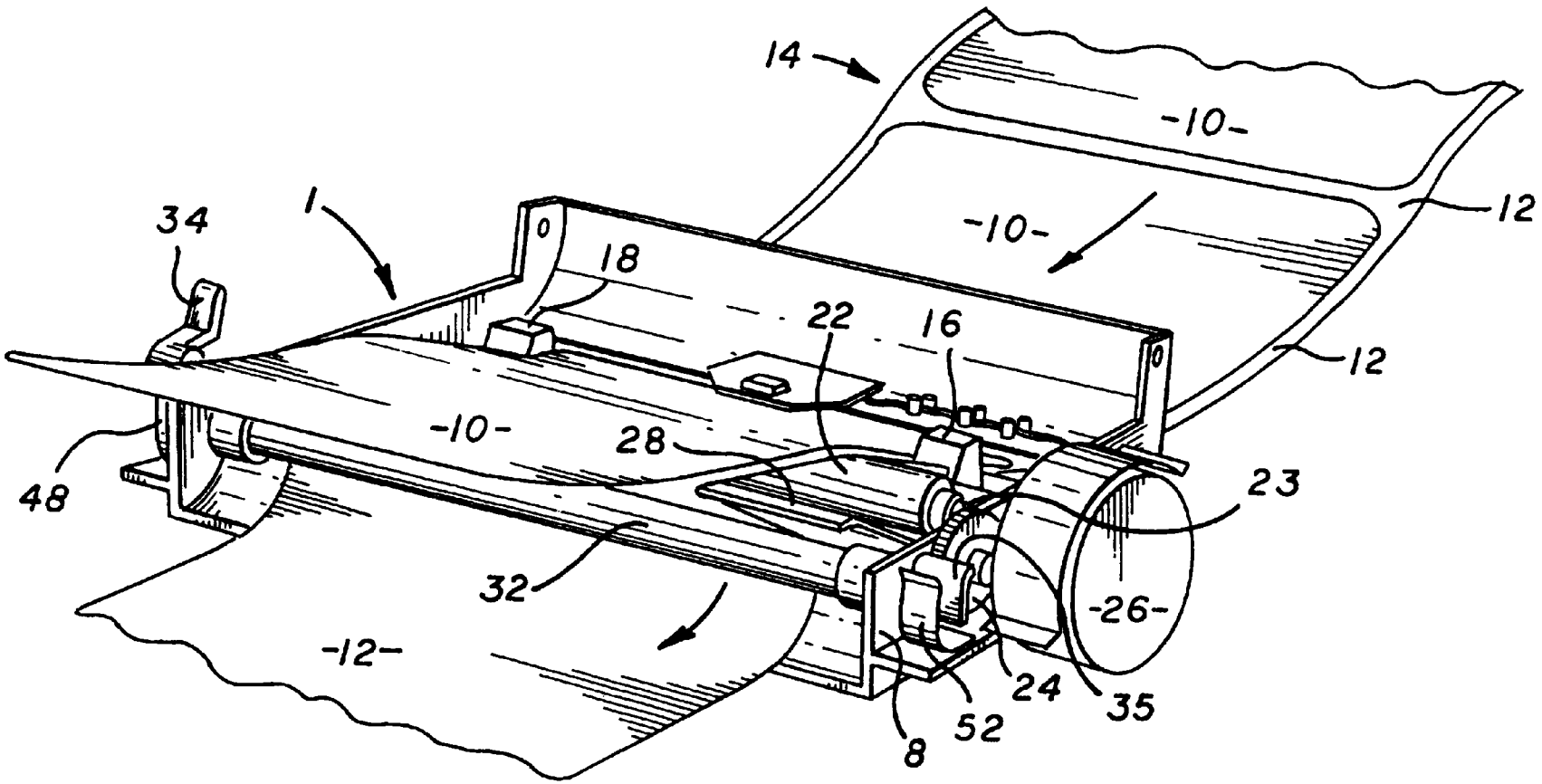
FIG. 1 shows an isometric view of a lower part of a printer according to the present invention.
Figure 2:
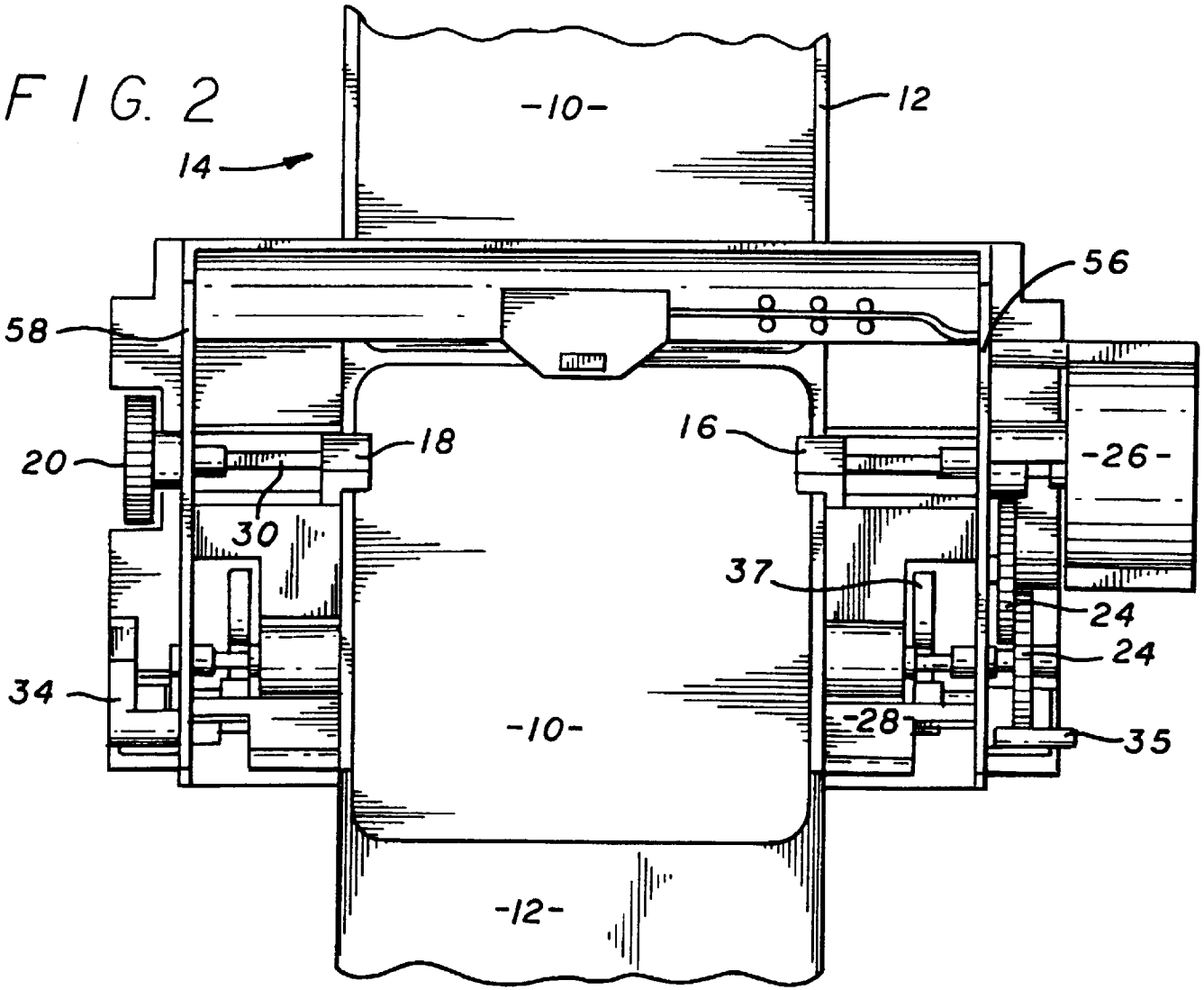
FIG. 2 shows a top plan view of the printer of FIG. 1 according to the present invention.

FIG. 1 shows a preferred embodiment of the present invention where a continuous label strip 14 is fed into a drive part 1 of a printer from a back side of the printer. The continuous label strip 14 comprises sequentially arranged self-adhesive labels 10 attached to a continuous protective backing strip 12. Each of the self-adhesive labels has a printable side and a self-adhesive side adhered to the protective backing 12. Moreover, the continuous label strip 14 is typically wound to form a label roll before being supplied into the printer. After entering the printer, the label strip 14 goes through and between two pathway guides 16, 18 for guiding the label strip 14 toward a front side of the printer. The pathway guides 16, 18 are movably coupled to a shaft 30, as shown in FIG. 2, and are equally spaced apart at opposite sides from a midpoint of the shaft 30. The midpoint of the shaft 30 is approximately located at the middle of the shaft 30 having an equal distance from opposite side walls 56, 58 of t he drive part 1. As a result, the pathway guides 16, 18 guide the label strip 14 to pass through the printer where the labels passing within the printer are centered therein to provide an optimum printing result.

The shaft 30 is rotatably coupled to the drive part 1 at the bottom by threading through opposite side walls 56, 58 of the drive part 1. The shaft 30 has right and left halves respectively coupled to pathway guides 16, 18, and has a middle part integrally coupled to the left and right halves at opposite ends. The middle part of the shaft 30 is also supported by a middle support rack of the drive part 1 for further supporting the shaft 30. The shaft 30 has worm notches across the left and right halves, but there are no notches on the middle part of the shaft 30. The worm notches have opposite rotational directions respectively on left and right halves of the shaft 30. A rotating nob 20 is securely coupled to the shaft 30 at the one end (left) for rotating the shaft 30. The pathway guides 16, 18 respectively have ring parts at their bottoms. The ring parts of the pathway guides 16, 18 encircle the respective right and left halves of the shaft 30 and have inner worm grooves meshing with the worm notches of the shaft 30. The meshing of the grooves and notches allows the pathway guides 16, 18 to move along the shaft 30 by rotating the shaft 30. However, due to the opposite rotational notch settings of the left and the right halves, the left and right halves of the shaft 30 will respectively cause the pathway guides 16, 18 to move in opposite directions along the shaft 30 when the shaft 30 rotates. Thus, when the shaft 30 rotates in a first direction, the pathway guides 16, 18 will be moved toward each other, and they will be moved away from each other when the shaft 30 rotates in a second direction, opposite to the first rotational direction. A user of the printer may therefore rotate the rotating nob 20 to adjust the relative distance between the pathway guides 16, 18 for accommodating different printing media having different dimensions.

The printer has a platen 22 disposed in the drive part 1, and has a print head (not shown) located in a print part, which is pivotally coupled to the drive part 1 at the back side. Thus, the print part may be pivotally opened from the drive part 1 for a loading position of a printing medium, such as the label strip 14, and may be closely engaged to the drive part 1 for an operation position. The print head is positioned over the platen 22 when the drive part 1 is closely engaged to the print part of the printer during operation. Therefore, in normal operation, the platen 22 will press the printing media, such as the label strip 14, tightly against the print head to allow forming data images on the printable side of the labels. The platen 22 has a platen shaft 23 rotatably coupled to the drive part 1 at opposite side plates 56, 58. Thus, when the platen 22 rotates during operation, it will drag the label strip 14 through the printer, thereby the labels of the label strip 14 could be sequentially printed by the print head.

To load the label strip 14, the label strip 14 is first inserted through an opening near the back side of the drive part 1. The label strip 14 then passes between the pathway guides 16, 18 horizontally and between the print head and the platen 22 vertically wherein the platen 22 is positioned beneath the label strip 14 and the print head is positioned over the label strip 14. The lower side of the label strip 14, that touches the platen 22, comprises the protective backing 12 while the upper side includes the printable surface of the labels 10. As stated, the label strip 14 is tightly trapped in the printer between the print head and the platen 22 when the printer is in the operation position. As a result, when the platen 22 rotates, it will force the label strip 14 to move through the printer in a direction tangential and centrifugal to a rotational direction of the platen 22. In the normal operation, the platen 22 rotates counterclockwise, viewed in from the right side plate 56 of the drive part 1, so that the label strip 14 is pulled by the platen 22 toward the front side of the printer. In addition, the platen 22 is connected by a gear system, having a series of gears including a gear 24 as indicated in FIG. 1, to a motor 26 positioned at the right end of the drive part 1. The motor 26 drives the gear system to rotates the platen 22 such that the platen 22 will urge the label strip 14 to move through the printer (see also FIG. 2).

Normally, the printer has a locking mechanism, which will be explained in the followings, to open up a gap between the print head and the platen 22 for inserting the label strip 14, or to closely engage them for the operation. During the printing operation, the print head is locked into place to contact the upper printable side of the labels 10. With the print head lowered into place and contacting the labels 10, a small amount of friction is created as the label strip 14 passes through and beneath the print head during printing. This small amount of friction is important to the operation of the present invention, as will be explained more detailedly in the paragraphs that follow.

Just after passing between the print head and the platen 22, the label strip 14 passes over a stripper bar 28 located at the front side of the printer 1, as shown in FIGS. 1 and 2. The stripper bar 28 is basically a flat panel plate, preferably made by stainless steel or other metal materials, having a wide center portion and two narrow portions, with same length, respectively positioned at opposite ends (left and right) of the stripper bar 28. In one example, the overall length of the stripper bar 28 is approximately 5.63 inches long, roughly the same length between the left and right side plates 56, 58 of the drive part 1. Thus, the stripper bar 28 may be coupled to the drive part 1 by inserting the narrow portions of the stripper bar 28 into respective receiving slots on the opposite side plates 56, 58. The center portion of the stripper bar 28 is approximately 4.75 inches long and is slightly longer than the platen 22, whose length is of approximately 4.4 inches. The stripper bar 28 is angled upward from a level position with its lower bottom end positioned close to, but not touching platen 22. The lower bottom end of the slanted stripper bar 28 is also positioned slightly above a surface intersection line, which is the tangential intersection line of the platen 22 and a vertical plane, of the platen 22. As will be explained in further details later, the angle of the stripper bar 28 is suitably positioned in order to separate a portion of the protective backing 12 from a label 10 directly over the stripper bar 28. In a preferred embodiment, the angle of the stripper bar 28 is approximately 30° to 50°, preferably 40°, measured from a level position upward. The angle of stripper bar 28, however, may be of any degree as long as it is suitable to separate the labels 10 from the protective backing 12 when the label strip 14 passes over the stripper bar 28.

Figure 3:
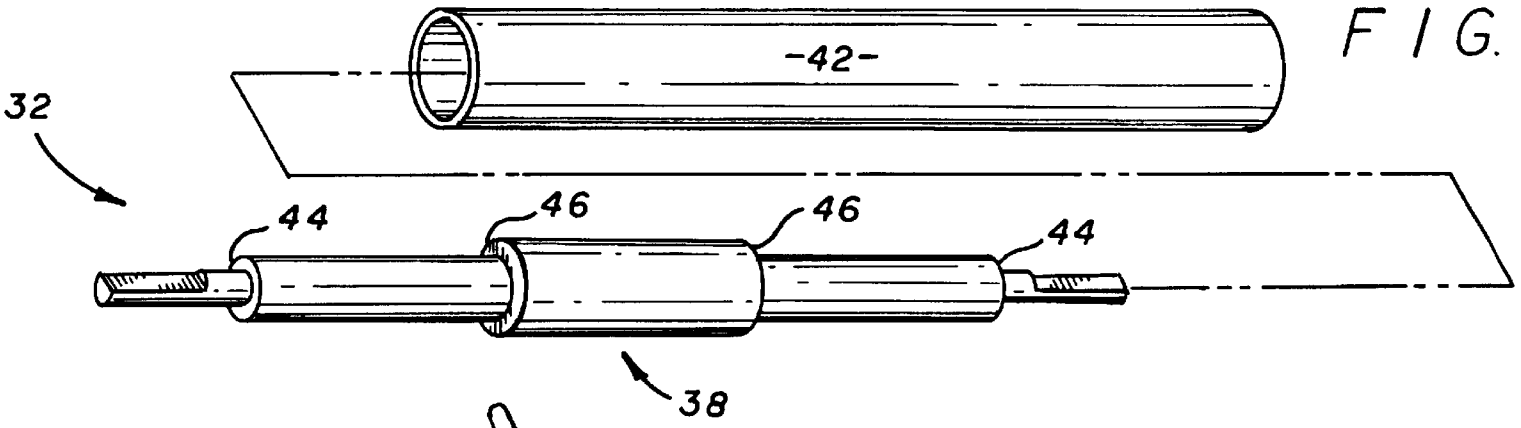
FIG. 3 shows an exploded view of the stripper roller of FIG. 1 according to the present invention.

After passing over the stripper bar 28, the labels 10 will be allowed to flow straight out of the printer at the front side, while the protective backing 12 will be threaded back underneath the stripper bar 28 and over, behind and then underneath a stripper roller 32. As shown in FIG. 3, the stripper roller 32 includes a shaft 38 movably coupled to the drive part 1 at opposite ends and a sleeve 42 rotatably encircling the stripper shaft 38. A pair of roller receiving holes (not shown) are respectively positioned at opposite side plates 56, 58 of the drive part 1 to receive the opposite ends of shaft 38. The roller receiving holes are of approximately elliptic shape in a slanted down position toward the front side, and are slightly larger than a diameter of shaft 38 to allow the stripper shaft 38 to reciprocally slide therein. The stripper roller 32 is located in front of and lower than the platen 22, thereby the position of the stripper roller shaft 38 is approximately 45° to 60° angled down from a horizontal plane passing through a center axle of the platen shaft 23. In normal operation, stripper roller 32 is pressed tightly against platen 22, while in the loading position, stripper roller 32 is urged away from the platen 22 for threading the protective backing 12 between the platen 22 and the stripper roller 32, as will be explained further.

Figure 4:
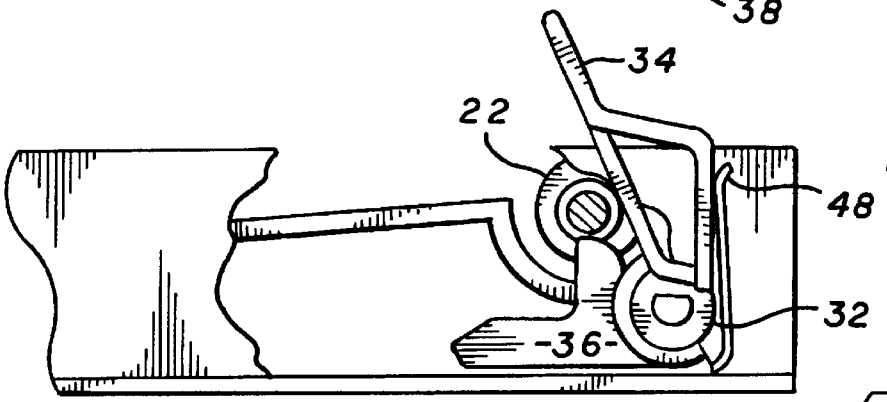
FIG. 4 shows a side elevational view of the stripper roller, a lever, the platen and a cam of the device shown in FIG. 1, with the lever in operational position.
Figure 5:
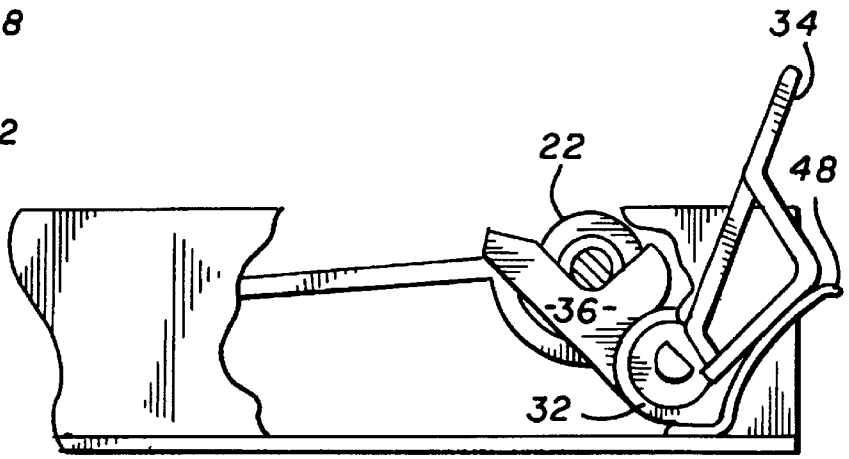
FIG. 5 shows a side elevational view of the stripper roller, the lever, the platen and the cam of the device shown in FIG. 1, with the lever in loading position.

A pair of left and right cam levers 37, 36 is rotatably coupled to the stripper shaft 38 near the opposite ends inside the respective side plates 56, 58, as shown in FIG. 2. The left and right cam levers 36, 37 respectively have extending portions having cam-shape contour and positioned directly underneath the platen shaft 23. In addition, a pair of levers 34, 35 is securely coupled to the stripper shaft 38 at the opposite ends (left and right) outside of the respective side plates 58, 56 of the drive part 1. Correspondingly, a pair of torsional springs 48, 52 urges the respective levers 34, 35, and thus the stripper roller 32, toward the back end of the drive part 1. Thus, the torsional springs 48, 52 urge the stripper roller 32 tightly against the platen 22 during operation. The lever 34 has an upwardly extending handle, as shown in FIG. 1, and a ring shape bottom securely encircling the stripper shaft 38, as shown in FIGS. 4 and 5. As a result, a user may pull the handle of the lever 34 to rotate the stripper shaft 38, which, in turn, rotates the cam levers 36, 37, thereby the stripper roller 32 may be forced to move toward or away from the platen 22 by the cam levers 36, 37, as will be explained in further details. In a preferred embodiment, the sleeve 42 is made of fluorinated ethylene propylene TEFLON, hereinafter referred to as FEP TEFLON due to the properties of the FEP TEFLON that are suitable to the operation of the present invention, as will be explained further detailed in the following paragraphs. However, it is possible that other materials may be used for the sleeve 42 as long as they produce similar results as the FEP TEFLON does for the present invention. Moreover, the platen 22 may be made of any suitable materials that are commonly adopted to make platens by persons skilled in the art.

The FEP TEFLON provides a number of advantages suitable for the sleeve 42 of the present invention. First, a bearing surface, which is on the outer surface of the sleeve that carries the protective backing 12, of the FEP TEFLON sleeve is smooth and offers little friction for the protective backing 12 to pass through. Second, the bearing surface of the FEP TEFLON sleeve is a none-sticking bearing surface. Therefore, in some rare cases, if a label is only partially peeled off after passing the stripper bar 28 and follows the protective backing 12 to the stripper roller 32, the label may stick to the sleeve 42 when it approaches the stripper roller 32. By having a non-sticking surface of the sleeve 42, peeling the stuck label off the FEP TEFLON sleeve 42 in this rare case of failure would be easier. Finally, a lubricant may be added between the sleeve 42 and the stripper shaft 38 to reduce a rotational friction between the sleeve 42 and the stripper shaft 38. It has been found that the FEP TEFLON is suitable to work with most lubricants. All these properties of the FEP TEFLON make it particularly suitable to be the material for the sleeve 42.

As can be seen in FIGS. 4 and 5 in conjunction with FIG. 1, in order to thread backing strip 12 around the stripper roller 32, the user will have to engage the lever 34, which is coupled to the adjacent left end of the stripper shaft 38 and to the cam lever 36. When rotated to a loading position by pulling the lever 34 toward the front end of the printer, as shown in FIG. 5, the lever 34 rotates the cam lever 36, and also the cam lever 37 at the other end of shaft 38. As can be seen in FIG. 6, the cam levers 36, 37 together urge the stripper roller 32 away from platen 22 creating enough room for the protective backing strip 12 to be threaded between the platen 22 and the stripper roller 32. FIG. 4 shows lever 34 and cam lever 36 in an operational position. As stated, the printer also comprises a pair of torsional springs 48, 52 for urging the stripper roller 32 against the platen 22 thereby maintaining a tight pressure between the stripper roller 32 and the platen 22 during operation. The torsional springs 48, 52 are respectively positioned outside of the side plates 58, 56 and before the levers 34, 35. The torsional springs 48, 52 respectively have extruding spring plates contacting the levers 34, 35 to urge the stripper roller 32 against the platen 22.

In an alternative embodiment, the levers 34, 35 and/or the cam levers 36, 37 may also be configured to release the print part from engaging to the drive part 1 of the printer so that the print head may be disengaged from contacting the platen 22 in order to allow the threading of the label strip 14 between the print head and the platen 22. In the above-mentioned alternative embodiment, the levers 34, 35 may respectively have cam-shape latches adjacent to the side plates 58, 56 and slightly higher than the top surface of the side plates 58, 56. Correspondingly, the print part of the printer has a pair of latching cams properly positioned relative to the cam-shape latches of the drive part 1 so that the cam-shape latches will latch with the latching cams of the print part when the two parts are pivotally closed to each other. The torsional springs 48, 52 also serve to urge the levers 34, 35 to lock with the print part during operation. As a result, the user may release the print part from engaging to the drive part 1, and also to simultaneously release the platen 22 from pressing against the stripper roller 32, by pulling the lever 34 toward the front side of the printer.

The labels 10 have printable front sides and adhesive back sides adhered to the protective backing 12. However, the protective backing typically has a gloss surface and most adhesive glue applied on the back side of the labels 10 are often not very sticky in order not to impede peeling off the labels from the protective backing 12. As a result, when the label strip 14 is bent over a certain angle, e.g., 45°, a label just over the bending line of the label strip 14 normally would separate apart from the protective backing 12 and moves in a tangential direction at the bending line relative to the protective backing 12. As noted, the label strip 14 is inserted into the printer through the opening at the back side of the drive part 1. Once entering the drive part 1, the label strip 14 passes through the pathway guides 16, 18 horizontally and between the print head and the platen 22 vertically for receiving printing images on the labels 10 from the print head. After passing through the platen 22, the label strip 14 proceeds over the upwardly angled stripper bar 28 for separating the labels 10 from the protective backing 12. Thereafter, the protective backing 12 is directed backward underneath the stripper bar 28 and over, behind and underneath the stripper roller 32 to come out of the drive part 1 from the bottom of the stripper bar 28, as shown in FIG. 1. Since the protective backing 12 is threaded back under the stripper bar 28, the labels 10 will ordinarily move tangentially toward the front side of the printer after passing the stripper bar 28 and will not follow the protective backing 12 to the underside of the stripper bar 28. Thus, the labels 10 will be automatically peeled off the protective backing 12 when they pass the stripper bar 28.

As noted, the protective backing 12 usually has a gloss and smooth surface on one side, which is attached to the adhesive side of the labels 10, to allow the labels 10 to be peeled off easily. Because the protective backing 12 is designed to allow the labels 10 to be peeled off very easily, the labels 10 can be separated from the protective backing 12 by folding the strip 14 at an edge of a label 10 over a certain critical angle. The critical angle of a specific self-adhesive label may be the same as or slightly different from others. In a preferred embodiment, the present invention comprises a stripper bar 28 having an acute upward angle of approximately 27° to 32° to ensure all labels 10 will be separated from the protective backing 12 when the strip 14 passes the stripper bar 28 while the protective backing is threaded back and underneath the stripper bar 28, as shown in FIG. 1.

After protective backing 12 is directed backward under the stripper bar 28, the protective backing 12 is threaded between the platen 22 and the stripper roller 32 to direct it out of the printer in a forward direction. The user will then pivotally fold down the print part to engage the drive part 1, and will move the lever 34 back into its operational position (as shown in FIG. 4), that rotates the cam levers 36, 37 and therefore moves the stripper roller 32, the platen 22, and the print head back to its operational position. Thus, the protective backing 12 is trapped between the stripper roller 32 and the platen 22, and the label strip 14 is trapped between the print head and the platen 22. As stated previously, the protective backing 12 may therefore be separated from the labels 10, which move directly out of the printer from over the stripper bar 28, and comes out of the printer through moving underneath the stripper roller 32.

As shown in FIG. 3, the stripper roller 32 comprises a stepped shaft 38 surrounded by the sleeve 42. In the preferred embodiment, the stepped shaft 38 is made of any 300 series stainless steel, and the sleeve 42 is made of FEP TEFLON, but other suitable materials may be adopted for shaft 38 or sleeve 42. In one example, the FEP TEFLON sleeve 42 has an exterior diameter of approximately 0.419 inches, an interior diameter of approximately 0.25 inches, and is approximately 4.72 inches in length. The stripper roller 38 is approximately 5.98 inches long. The stripper roller shaft 38 has a first diameter, measured on the portion of the shaft 38 from either end of the stripper roller shaft 38 to a set of first steps 44, of approximately 0.156 inches; a second diameter, measured on the portions of the shaft 38 from either first step 44 to an adjacent second step 46, of approximately 0.204 inches; and a third diameter, measured on the portion of the stripper roller shaft 38 between the two second steps 46, of approximately 0.236 inches. The stripper roller shaft 38 is generally symmetrical, with the distance (in the same example) between either end and the adjacent first step 44 of approximately 0.62 inches, the distance between either first step 44 and the adjacent second step 46 of approximately 1.87 inches, and the distance between the two second steps 46 of approximately 1.0 inches. As can be seen, even at the point of the greatest diameter, i.e., the third diameter, of the stripper roller shaft 38 there is a radial clearance between the stripper roller shaft 38 and the FEP TEFLON sleeve 42 of about 0.014 inches. This clearance (in addition to other inherent properties of FEP TEFLON) permits the FEP TEFLON sleeve 42 to rotate freely about the stripper roller shaft 38. As a result, the stripper roller shaft 38 does not generally rotate during normal operation.

When the printer is operational, the motor 26 turns the gears of the gear system 24, which, in turn, rotate platen 22 to urge the label strip 14 to move forward by passing between the print head and platen 22. During printing, the print head prints data on labels 10 and creates a small amount of friction on label strip 14 when it slides over the print head. The small amount of friction has a slight slowing effect on the speed of label strip 14. Moreover, the pressure from platen 22 against the protective backing strip 12 and the stripper roller 32 drives the stripper roller 32 to rotate and thus forces the protective backing strip 12 to pass underneath the stripper roller 32.

Due partially to the gloss surface of the protective backing 12, it has been found that when the protective backing 12 passes between the platen 22 and the stripper roller 32, it encounters less resistance than the label strip 14 passing between the print head and the platen 22. Therefore, when the printer starts to print, the stripper roller 32 and the platen 22 together will initially pull the protective backing 12 faster than the print head and the platen 22 pulling the label strip 14. As a result, a small tension will be gradually accumulated in a section of the protective backing 12 between the stripper roller 32 and the print head. An equilibrium level of the tension is reached when the stripper roller 32 can no longer overcome the friction created by the print head and move the protective backing 12 at a faster rate than that traveled at by the label strip 14. Therefore, the tension will be kept accumulating until such time that the tension in the protective backing 12 becomes strong enough to counter act the speed differential. At this point, the tension reaches the equilibrium level and the protective backing 12 and the label strip 14 will be moved in a same speed. Once the equilibrium level of the tension is reached, the printer tends to move the protective backing 12 and the label strip 14 at the same speed while maintaining the equilibrium tension level on the protective backing 12 to keep it straight.

Moreover, whenever there is a slack of the protective backing 12 initially, the speed differential will again cause the tension to increase toward the equilibrium level. As a result, the tension built up thereon will help straighten the portion of the protective backing 12 between the stripper roller 32 and the stripper bar 28. This tension on the protective backing 12 will not only straighten the protective backing 12 but also help the printer avoid undesirable looping of the protective backing 12, or other forms of failure of the label strip 14 associated with the slack paper problem.

As labels 10 are printing, the acute angle of the fold of the label strip 14, as it passes over the stripper bar 28 while the protective backing 12 is threaded back and then under the stripper bar 28, continues to separate the protective backing 12 from the labels 10. In addition, the above-noted tension will also help maintaining the proper angle of the fold as the label strip 14 passes over the stripper bar 28. Should the tension become too great, the FEP TEFLON sleeve 42 will "slip" against the protective backing 12 and thus maintains the equilibrium level of tension on the protective backing 12 and the label strip 14 for proper printing. The "slip" of the FEP TEFLON sleeve 42 is partly due to the lubricants filled in the radial clearance between the FEP TEFLON sleeve 42 and the stripper shaft 38.

Most conventional printing devices do not experience the above-mentioned initial speed differential and are subject to failures, particularly the looping of the label strip 14 and/or of the protective backing 12. The conventional devices also have no mechanisms to maintain tension on, and, thus, to straighten, the backing 12. This problem is especially acute with thermal transfer printers, which cause less drags of printing strips than direct thermal printers and do not have the same magnitude of frictions to cause a speed differential that increases the tension of the protective backing 12. A similar problem also exists when a narrow media (e.g., less than one inch wide) is used. Such a narrow printing surface has been found particularly susceptible to looping and failure unless a sufficient tension is maintained between the strip 14 and the protective backing 12. The looping problem of the conventional printing devices when used in conjunction with the narrow media is primarily due to the fact that the conventional printing devices, when designed and built, normally do not take into consideration to accommodate the narrow media.

In contrast, the present invention does not have the above-mentioned problems encountered by thermal transfer printers and/or for using narrow print media. To begin with, it has been found that implementing the present invention causes sufficient tension on protective backing strip 12 to prevent the looping problem in thermal transfer printers and/or of the narrow printing media. Moreover, stepped stripper roller shaft 38 of the present invention is particularly suitable for accommodating narrow print media. As previously mentioned and shown in FIG. 3, the center portion of stripper roller shaft 38, which is between the set of second steps 46, has the largest diameter on the stepped shaft 38 which in one example is of approximately 0.236 inches and of approximately 1.0 inches in length, respectively. Only the center portion of the stripper roller shaft 38 touches and presses against the encircling FEP TEFLON sleeve 42 during operation when the FEP TEFLON sleeve 42 rotates about the stripper roller shaft 38. Thus, the stepped shaft 38 helps stripper roller 32 press against the protective backing strip 12 by focusing most of the pressure on the center portion of the protective backing strip 12. When a narrow printing strip is used, even as narrow as one inch long, the present invention will still provide adequate pressing force more evenly distributed on the narrow strip to move a protective backing of the narrow strip through the printer.

From the foregoing, it will be appreciated that, although specific embodiments of the invention have been described herein for purposes of illustration, various modifications may be made by persons skilled in the art without deviating from the spirit and/or scope of the invention. For example, the dimensions of the stripper roller, and its relevant parts such as the stripper shaft, may be changed to accommodate different printing devices. The relative proportion of different parts of the stripper roller shaft may also be changed to accommodate any specific purpose. The sleeve may be made of materials, other than the FEP TEFLON, suitable to create speed differential and to "slip." Furthermore, the angle of the stripper bar may be changed to ensure the labels will be separated from the protective backing when the strip passes over the stripper bar while the protective backing is threaded back and underneath the stripper bar. Accordingly, the present invention is not limited except as by the appended claims and their equivalents.

What is claimed is:

1. A roller operatively coupled to a platen for pulling a media backing strip, said roller comprising:

(a) a shaft including at least one raised cylindrical central step; and (b) a tubular sleeve driven by the platen and adapted to rotate freely about said shaft encircling said at least one raised central step and contacting the media backing strip, said at least one raised central step adapted to act as a bearing surface for said tubular sleeve and being shorter in length than said tubular sleeve to cause said sleeve to distribute pressure over a central portion of the media backing strip corresponding to the length of said at least one raised central step when the width of the media backing strip is greater than the length of said at least one raised central step, and over the entire width of the media backing strip when the width of the media backing strip is less than or equal to the length of said at least one raised central step to prevent excessive looping of the media backing strip.

2. The roller of claim 1, wherein said at least one raised cylindrical central step is defined by a first diameter and said tubular sleeve is defined by an outer diameter and an inner diameter, said first and inner diameters defining a radial clearance to allow said tubular sleeve to rotate freely about said shaft.

3. The roller of claim 2, wherein the radial clearance is filled with lubricants to allow said tubular sleeve to slip to maintain an equilibrium level of tension on the moving media backing strip.

4. The roller of claim 1, wherein said tubular sleeve is made of FEP TEFLON.

5. The roller of claim 1, wherein said tubular sleeve is adapted to press the media backing strip against the platen for pulling the media backing strip out of a support frame at a speed adapted to cause tension on the media backing strip.

6. The apparatus for advancing a media strip having protective backing in an image forming device equipped with a printhead, said apparatus comprising:

(a) a support frame including first and second walls;

(b) a roller comprising:

(i) a generally cylindrically-shaped shaft coupled at opposite ends to said support frame and having a first diameter and a second diameter greater than said first diameter, said second diameter defining a raised central step, and (ii) a tubular sleeve freely rotatable about said shaft and encircling at least said raised central step of said shaft, said tubular sleeve having a continuous surface adapted to contact the protective backing strip, said raised central step adapted to act as a bearing surface for said tubular sleeve and being shorter in length than said tubular sleeve to cause said sleeve to distribute pressure over a middle portion of the protective backing strip corresponding to the length of said raised central step when the width of the protective backing strip is greater than the length of said raised central step, and over the entire width of the protective backing strip when the width of the protective backing strip is less than or equal to the length of said raised central step to prevent excessive looping of the protective media backing strip;

(c) a platen rotatably coupled at opposite ends to said first and second walls of said support frame opposite the printhead; and (d) means for separating printed media from the protective backing strip, said roller adapted to press the protective backing strip against said rotatable platen for pulling the protective backing strip at a speed adapted to cause tension on the protective media backing strip.

7. The apparatus of claim 6, wherein said separating means includes a stripper bar coupled to said first and second walls of said support frame downstream from said platen.

8. The apparatus of claim 6, wherein said platen is adapted to rotatably press the media strip against the printhead to pull the media strip toward said separating means, said media strip being pulled between said platen and the printhead initially at a lower speed than the speed at which the protective backing strip is being pulled downstream between said roller and said platen to define a speed differential, said spped differential being subsequently reduced to zero.

9. The apparatus of claim 8, wherein said tubular sleeve is adapted to slip to maintain said zero speed differential.

10. The apparatus of claim 6, further comprising means for moving said roller away from said platen to load the protective media backing strip over, behind and underneath said roller.

11. The apparatus of claim 10, further comprising means for urging said roller against said platen to pull the protective backing strip out of said support frame.

12. The apparatus of claim 6, further comprising spring means operatively coupled to each end of said shaft.

13. An apparatus for advancing a media strip having protective backing in an image forming device equipped with a printhead, said apparatus comprising:

(a) a support frame including first and second walls;

(b) a roller comprising:

(i) a generally cylindrically-shaped shaft coupled at opposite ends to said support frame and having a first diameter and a second diameter greater than said first diameter, said second diameter defining a raised central step, and (ii) a tubular sleeve freely rotatable about said shaft and encircling at least said raised central step of said shaft, said tubular sleeve having a continious surface adapted to contact the protective backing strip, said raised central step adapted to act as a bearing surface for said tubular sleeve and being shorter in length than said tubular sleeve to cause said sleeve to distribute pressure over a middle portion of the protective backing strip corresponding to the length of said raised central step when the width of the protective backing strip is greater than the length of said raised central step, and over the entire width of the protective backing strip when the width of the protective backing strip is less than or equal to the length of said raised central step to prevent excessive looping of the protective media backing strip;

(c) a platen rotatably coupled at opposite ends to said first and second walls of said support frame opposite the printhead; and (d) a stripper bar coupled to said first and second walls of said support frame downstream from said platen and having a first end disposed proximate to said platen and a second end disposed away from said first end for separating printed media from the protective backing strip, said roller adapted to press the protective backing strip against said rotatable platen for pulling the protective backing strip at a speed adapted to cause tension on the protective media backing strip, said printed media being separated from the protective backing strip over said second end of said stripper bar as the protective backing strip is being pulled by said platen and said roller under said stripper bar.

14. An apparatus for separating media from a media backing strip including a platen operatively coupled to a support frame, said apparatus comprising:

(a) a stripper bar coupled to the support frame proximate to the platen for separating media from the media backing strip; and (b) a stripper roller disposed downstream from said stripper bar and operatively coupled to the platen for pulling the media backing strip out of the support frame, said stripper roller comprising:

(i) a shaft operatively coupled at opposite ends to the support frame and including at least one raised cylinfrical central step; and (ii) a tubular sleeve driven by said platen and adapted to rotate freely about said shaft encircling said at least one raised central step, said tubular sleeve having a continuous surface for contacting the media backing strip, said at least one raised central step adapted to act as a bearing surface for said tubular sleeve and being shorter in length than said tubular sleeve to cause said sleeve to distribute pressure over a central portion of the media backing strip corresponding to the length of said at least one raised central step when the width of the media backing strip is greater than the length of said at least one raised central step, and over the entire width of the media backing strip when the width of the media backing strip is less than or equal to the length of said at least one raised central step to prevent excessive looping of the media backing strip.

15. The apparatus of claim 14, wherein said tubular sleeve is made of FEP TEFLON.

16. The apparatus of claim 14, further comprising means for moving said stripper roller away from the platen to load the media backing strip over, behind and underneath said tubular sleeve of said stripper roller.

17. The apparatus of claim 16, further comprising means for urging said stripper roller against the platen to pull the media backing strip out of the support frame.

18. The apparatus of claim 14, wherein said tubular sleeve is adapted to slip to maintain an equilibrium level of tension on the moving media backing strip.

19. An apparatus for separating imaged print media from a continuous strip of protective backing in an image forming device having a rotatable platen, said apparatus comprising:

a stripper bar disposed downstream from said platen and adapted to separate imaged print media from said continuous strip of protective backing;

a stripper roller disposed downstream from said stripper bar for moving said protective backing away from said stripper bar, said stripper roller comprising a stepped shaft and a tubular sleeve encircling said stepped shaft in a substantially symmetrical manner and adapted to rotate about said shaft;

at least one cam coupled to said stripper roller shaft under said platen;

at least one lever operatively coupled to said cam and said stripper roller shaft and adapted to rotate said stripper roller shaft between a first position in which said protective backing is sandwiched between said tubular sleeve and said rotatable platen and a second position in which said at least one cam urges said stripper roller away from said platen to facilitate loading of said protective backing between said tubular sleeve of said stripper roller and said platen; and at least one spring operatively coupled to said at least one lever for urging said tubular sleeve of said stripper roller against said rotatable platen.

20. An image forming device, comprising:

(a) a print head;

(b) rotatable platen disposed under said print head;

(c) means for stripping imaged print media from a continuous strip of protective backing, said stripping means disposed downstream from said rotatable platen; and (d) a roller disposed downstream from said stripping means and comprising:

(i) a shaft having at least one cylindrical raised central portion, at least one cylindrical lower end portion disposed on each side of said at least one cylindrical raised central portion, and;

(ii) a tubular sleeve encircling entirely said at least one cylindrical raised central portion and said at least one cylindrical lower end portion on each side of said at least one cylindrical lower end portion and adapted to rotate freely about said shaft, said at least one cylindrical raised central portion acting as a bearing surface for said rotating tubular sleeve.

21. An apparatus for separating imaged print media from a continuous strip of protective backing in an image forming device having a rotatable platen, said apparatus comprising:

(a) a support frame having first and second walls respectively positioned at opposite sides;

(b) a roller comprising:

(i) a shaft of generally cylindrical stepped shape coupled to said first and second walls of said support frame at opposite ends, and (ii) a tubular sleeve rotatably encircling said stepped shaft; and (c) stripper means coupled to said first and second walls of said support frame forward of said rotatable platen for separating said imaged print media from said continuous strip of protective backing, said roller disposed downstream from said stripper means and adapted to press said continuous strip of protective backing against said rotatable platen for pulling said protective backing at a speed adapted to cause tension on said strip of protective backing.

22. An apparatus for automatically separating self-adhesive labels from a continuous strip of protective backing, said apparatus comprising:

a print head;

a platen positioned under said print head for pressing the continuous strip against said print head and advancing the continuous strip;

a stripper bar disposed forward of said platen and adapted to separate the self-adhesive labels from the continuous strip of protective backing;

a roller disposed downstream from said stripper bar and comprising a shaft of a stepped shape and a sleeve shorter than said shaft and encircling said shaft in a substantially symmetrical manner whereby said sleeve is adapted to rotate freely about said shaft;

means for urging said roller against said platen during operation; and means for moving said roller away from said platen to facilitate loading of the protective backing strip over, behind and underneath said roller.

23. An apparatus for automatically separating self-adhesive labels from a continuous strip of protective backing, said apparatus comprising:

a print head;

a platen positioned under said print head;

a stripper bar located forward of said platen;

a stripper roller comprising a tubular sleeve and a shaft encircled within said sleeve;

means for moving said stripper roller away from said platen for loading of the protective backing strip; and a spring located at each end of said stripper roller.

24. A method for separating self-adhesive labels from a continuous strip of protective backing in am image forming device having a platen rotatably coupled under a printhead, said method comprising the steps of:

moving the strip between the print head and the platen at a first speed;

separating the labels from the protective backing strip by passing the strip over a stripper bar positioned forward of the platen;

passing the protective backing under the stripper bar and over, behind and underneath a stripper roller pressing against the platen at a second speed being initially slightly greater than the first speed, the initial speed differential tensioning the strip; and equalizing the first and second speeds when the tension on the protective backing strip reaches an equalibrium.

25. A method of claim 24, further comprising the step of: directing the protective backing out from under the stripper roller.

26. The method of claim 24, further comprising the step of adapting said stripper roller to slip to maintain siad equilibrium.

27. A method for separating self-adhesive labels of a continuous strip from a protective backing of the strip, said method comprising the steps of:

rotating a platen to move the strip and the protective backing;

passing the strip over a stripper bar;

threading the protective backing back and under the stripper bar;

passing the protective backing over, behind and underneath a stripper roller positioned under the platen wherein the stripper roller is pressed against the platen;

moving the backing strip between a print head and the platen at a first speed;

moving the protective backing past the stripper roller at a second speed, the second speed being slightly faster than the first speed of the strip past the print head during the initial operation period of the apparatus;

increasing tension on the protective backing during the initial operation period due to a difference of the first and second speeds; and equalizing the first and second speeds traveled at by the strip and the protective backing respectively when the tension of the protective backing reaches an equilibrium.

28. A method for advancing a media backing strip using a platen rotatably coupled under a printhead and a stripper roller disposed downstream from said printhead and operatively coupled to the platen, said method comprising the steps of:

moving the media backing strip initially faster between the stripper roller and the platen than between the platen and the printhead to define a speed differential, said speed differential tensioning the media backing strip; and reducing subsequently said speed differential to zero to allow the tension on the media backing strip to reach an equalibrium state.

29. The method of claim 28, further comprising the step of adapting the stripper roller to slip to maintain said equilibrium state.

* * * * *